US005257576A

United States Patent [19]

Pearce et al.

[11] Patent Number: 5,257,576

[45] Date of Patent: Nov. 2, 1993

[54] CRUSHING APPARATUS

[75] Inventors: Kenneth M. Pearce, Baden; John M. Willoughby, Kitchener, both of Canada

[73] Assignee: Sensitive Environmental Systems Corporation, Kitchener, Canada

[21] Appl. No.: 772,879

[22] Filed: Oct. 8, 1991

[51] Int. Cl.[5] ..... B30B 15/16; B30B 9/04

[52] U.S. Cl. ..... 100/48; 100/53; 100/116; 100/131; 100/245; 100/269 R; 100/902

[58] Field of Search ..... 100/48, 53, 116, 131, 100/136, 245, 246, 269 R, 902, 295

[56] References Cited

U.S. PATENT DOCUMENTS

| | | | |
|---|---|---|---|
| 11,299 | 7/1854 | Chadwick | 100/116 X |
| 226,166 | 4/1880 | Fanning | 100/116 X |
| 231,840 | 8/1880 | Neahous | 100/245 X |
| 2,343,871 | 3/1944 | Livoti | 100/269 R X |
| 2,904,097 | 9/1959 | Cohen | 100/53 |
| 2,982,200 | 5/1961 | Robertson et al. | 100/53 |
| 3,055,289 | 9/1962 | Komph, Sr. | 100/53 |
| 3,104,607 | 9/1963 | Galas | 100/53 |
| 3,352,230 | 11/1967 | Hunnicutt | 100/53 |
| 4,019,984 | 4/1977 | Mohn | 100/116 X |
| 4,047,872 | 9/1977 | Karlsson | 100/245 X |
| 4,444,099 | 4/1984 | Paleschuck | 100/269 R X |
| 4,599,941 | 7/1986 | Johnson et al. | 100/902 X |
| 4,927,085 | 5/1990 | Oberg | 100/902 X |
| 5,109,763 | 5/1992 | Morris et al. | 100/902 X |

*Primary Examiner*—Stephen F. Gerrity

*Attorney, Agent, or Firm*—Anthony Asquith & Co.

[57] ABSTRACT

The apparatus is for crushing used automotive oil filters, and for squeezing out and collecting the dirty oil. The used filter is placed on the platen of a piston, which is actuated directly by pneumatic pressure. The piston has an area of 400 sq cm, giving a crush force of 3 to 4 tonnes. There are no other moving parts associated with the movement of the piston. The piston platen is set in a chamber with a window for receiving the filter, and a door closes off the chamber during crushing. A pneumatic trip valve is actuated by the act of closing the door, to pressurize the piston. The piston is guided in bearings, comprising strips of anti-friction material set in the cylinder walls, which rub on the same surface as the pneumatic seal. The piston is very heavy and returns under its own weight when pressure is released. The seal/bearing surface of the piston is well lubricated by being splashed with oil from the crushed filter. Grooves in the platen direct jetting oil away from the door.

15 Claims, 10 Drawing Sheets

CRUSHING APPARATUS

This invention relates to an apparatus for crushing or compacting such items as used, dirty, automotive oil filters.

BACKGROUND TO THE INVENTION

Used oil filters from automotive engines are becoming increasingly difficult to dispose of. An oil filter comprises a cylindrical canister of sheet metal, in which is housed a body of fibrous filter material, held in place by a tube of thin perforated metal. At the open end of the filter is a much thicker base piece, and a rubber sealing ring.

The apparatus provided by the invention is aimed at crushing the used oil filter along its axis, whereby the thicker base piece remains flat.

The apparatus provided by the invention typically is used by a mechanic in a service station. The mechanic removes the used oil filter from the vehicle, and inserts the oil filter into the apparatus. He then operates the apparatus to crush the oil filter, in order firstly to compact the solid parts of the oil filter structure into a smaller volume, but also, just as importantly, to squeeze the dirty oil out of the filter.

A used oil filter that has been compacted to perhaps 25% or less of its height, and which has had 95% of the dirty oil squeezed out of it, becomes much less of a problem from the disposal standpoint. Such a crushed filter can be disposed of in a land-fill in many jurisdictions, whereas an uncrushed, dirty-oil-laden filter, cannot.

In fact, an apparatus which squeezes oil filters to that degree, as is the aim of the apparatus of the invention, can pay for itself from the savings in disposal costs, apart from the environmental benefits.

GENERAL FEATURES OF THE INVENTION

The invention provides an apparatus in which the object to be crushed is placed on the platen of a piston. The piston is activated pneumatically.

A force in the range 20 to 40 kN (2 to 4 tonnes) is required to properly crush an oil filter. A typical air compressor, of the kind likely to be found in an automotive service station, produces air in the pressure range of 550–1000 kN/sq-m (80–150 psi). The area of the piston in the crusher apparatus preferably should be about 400 sq-cm in order to achieve the required magnitude of force when the piston is exposed to that pressure. It is a limitation of the invention that the area of the piston is at least 300 sq-cm.

In the invention, the pneumatic pressure acts directly upon the piston, whereby there are no linkages or moving parts of any kind in the load line to the piston, other than the piston itself. Preferably the piston includes a skirt having a cylindrical surface which slidably engages a suitable seal. Preferably, the piston is guided in bearings which engage the same cylindrical surface.

Preferably the piston is mounted for vertical up/-down sliding motion. The piston is topped by a platen which lies in a crusher chamber. The oil filter to be crushed is placed on the platen. A door is provided for closing off the crusher chamber during crushing.

As the piston rises under pressure, the said cylindrical surface of the skirt of the piston emerges into the crusher chamber. The oil squirting and jetting out of the filter as it is crushed splashes all around the crusher chamber, and splashes the cylindrical surface. As a result, the surface is very well lubricated with oil during use, although the oil is of course dirty.

The piston is preferably very heavy, whereby, especially since the piston is so well lubricated, the piston falls under its own weight when the air pressure is released.

As a result, the piston does not need to be mechanically connected to any other component, neither for the crushing stroke, nor for the return stroke, of the piston. The apparatus is therefore very simple in its construction, which makes for economical manufacture. Because of the lack of interacting moving parts, the apparatus can also be expected to have a long trouble-free service life.

The piston is guided in bearings which preferably engage the same surface of the skirt of the piston as the pneumatic seal. As such, the piston is extremely robustly located, and is highly resistant to tipping and rocking due to sideloads. Such sideloads can arise, for example, when a filter is misplaced on the platen, and it is important to ensure that the filter cannot tip sideways when crushed. If that were to happen, the metal of the canister of the filter might tear, which is hazardous. When the filter is crushed "straight-on", the filter is compressed to a maximum extent, and the incidence of the metal tearing is negligible.

When the piston is guided in these huge bearings, as described, the piston will remain straight even with the filter considerably off centre of the platen. Apart from being guided in the bearings, the piston floats, and is moved only by the pressure of air acting directly upon it, and by its own weight.

The apparatus includes a means for supplying pneumatic pressure to the piston. preferably, the air supply is activated by the opening and closing of the door of the crusher chamber. When the door is closed, the piston is supplied with air pressure; when the door is open, the piston is exhausted. That is to say: when the door is closed the piston is forced up; and when the door is open the piston drops down.

This manner of actuation is such that the mechanic need address very little attention to the task of operating the crusher. Even so, crushing takes place in a controlled manner, and safety is excellent in that the mechanic can hardly place his hands etc in danger.

In the preferred operating system, to operate the crusher, the mechanic opens the door; this action operates a pneumatic trip valve which exhausts any air pressure being fed to the piston. The piston therefore descends, opening up the crusher chamber, into which the mechanic inserts the filter. He then closes the door. This action admits air pressure to the piston, and causes crushing to commence. If the mechanic should open the door at this point, by mistake, the air pressure is again exhausted, causing the piston to drop. He might be splashed with oil, but he would not be in any danger of his fingers being crushed.

Thus, whenever the mechanic opens the door, the piston drops. The mechanic simply opens the door, places the filter inside, then closes the door again. He might take the crushed filter out a few seconds later, or, if he forgets, he might leave the filter in until he uses the apparatus again. No safety difficulty arises from this.

The operation of crushing filters is an "extra" task for the mechanic to do, and one he might neglect if the task required of him some degree of operating skill or attention. The act of opening a door, placing a filter inside, then closing the door and walking away, is so simple a task that even the most casual mechanic will not avoid doing it.

DETAILED DESCRIPTION OF PREFERRED EMBODIMENT

By way of further explanation of the invention, an exemplary embodiment of the invention will now be described with reference to the accompanying drawings, in which.

Figure 1:
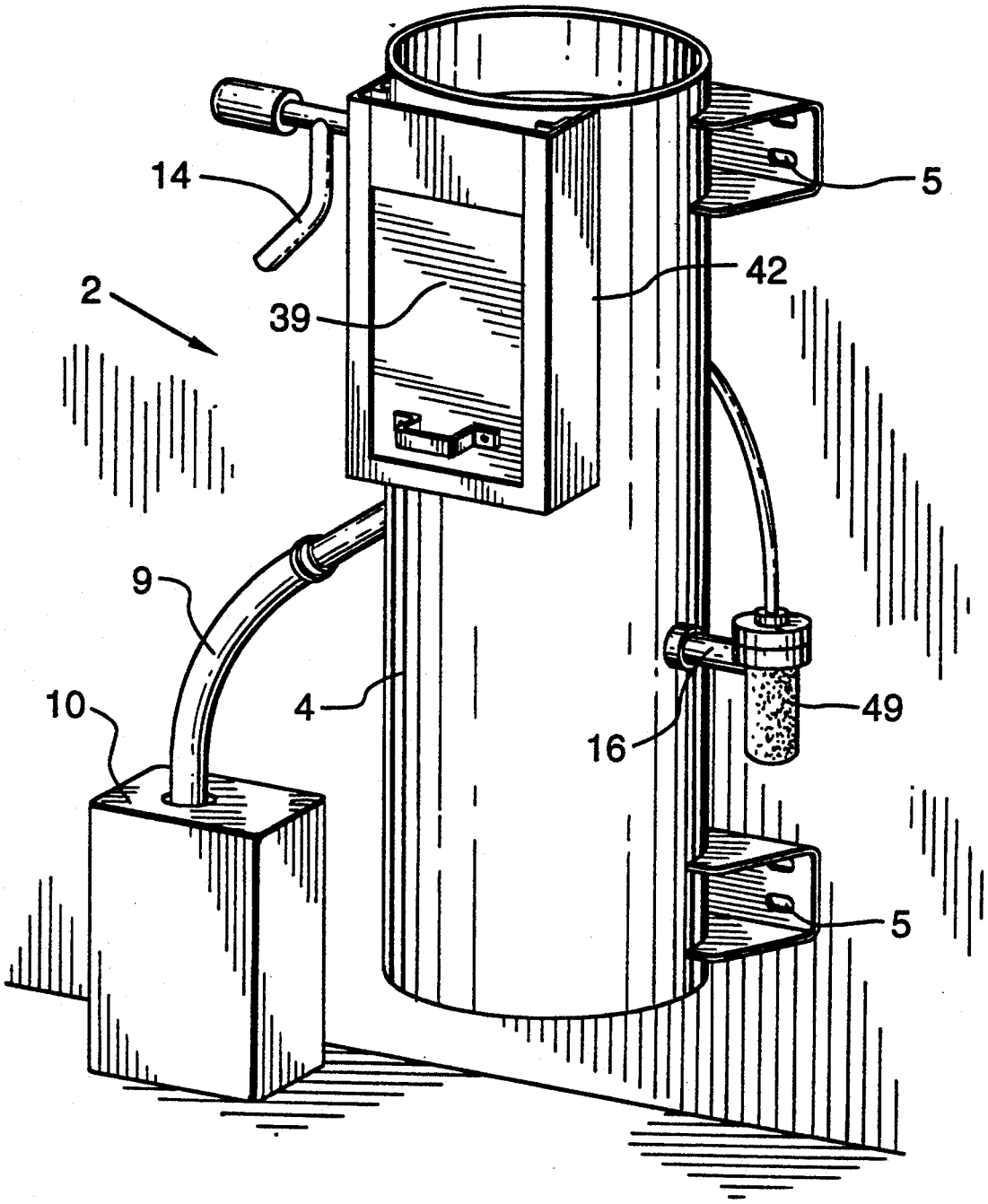
FIG. 1 is a pictorial view of a crusher apparatus which embodies the invention.

The apparatus shown in the accompanying drawings and described below are examples which embody the invention. It should be noted that the scope of the invention is defined by the accompanying claims, and not necessarily by specific features of exemplary embodiments.

The crusher 2 shown in the drawings includes a main body, which comprises a length of cylindrical steel tube 4. The body is attached to a wall through bolts 5.

Figure 1A:
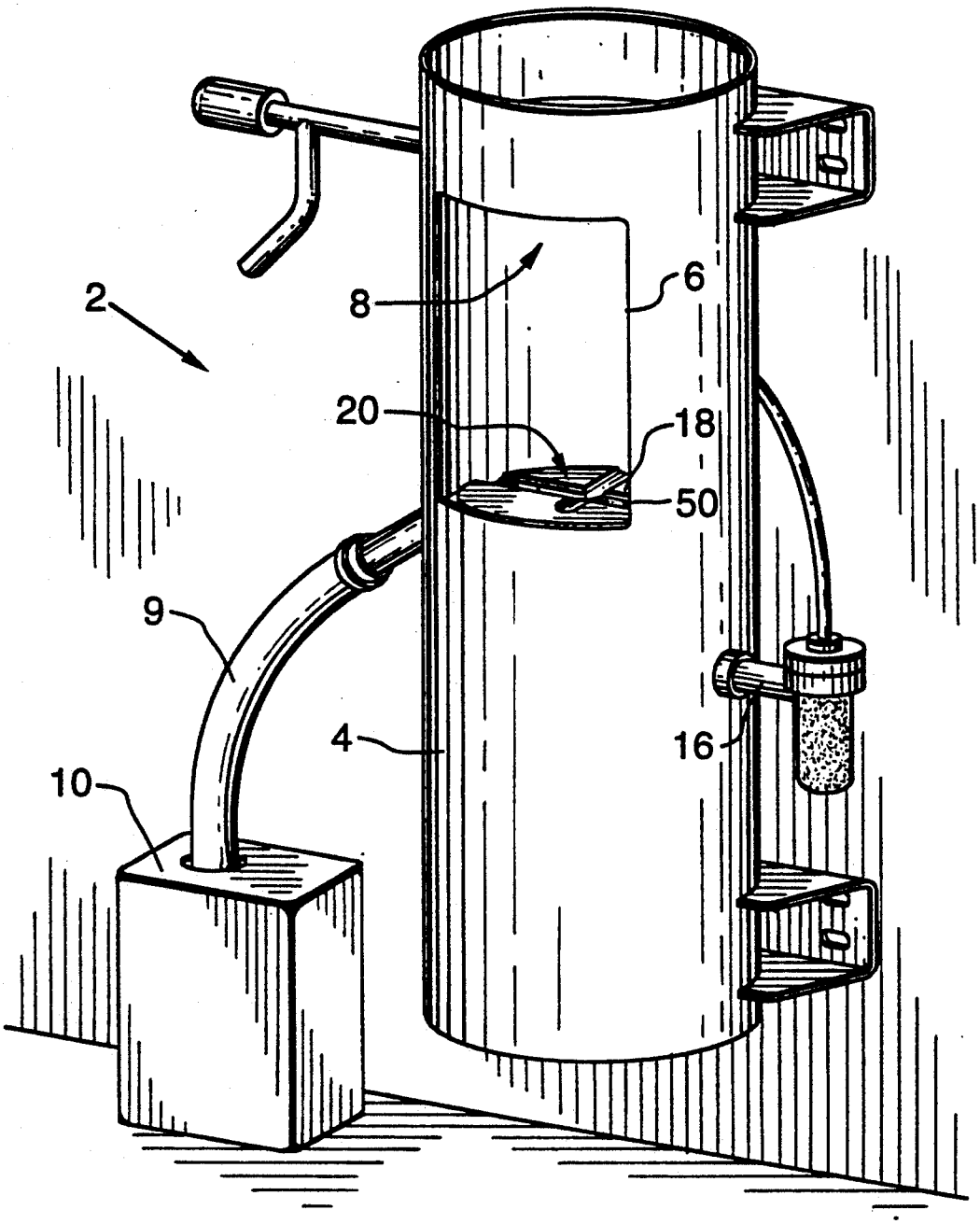
FIG. 1A is the same view as FIG. 1, but is shown with some of the components removed.
Figure 1B:
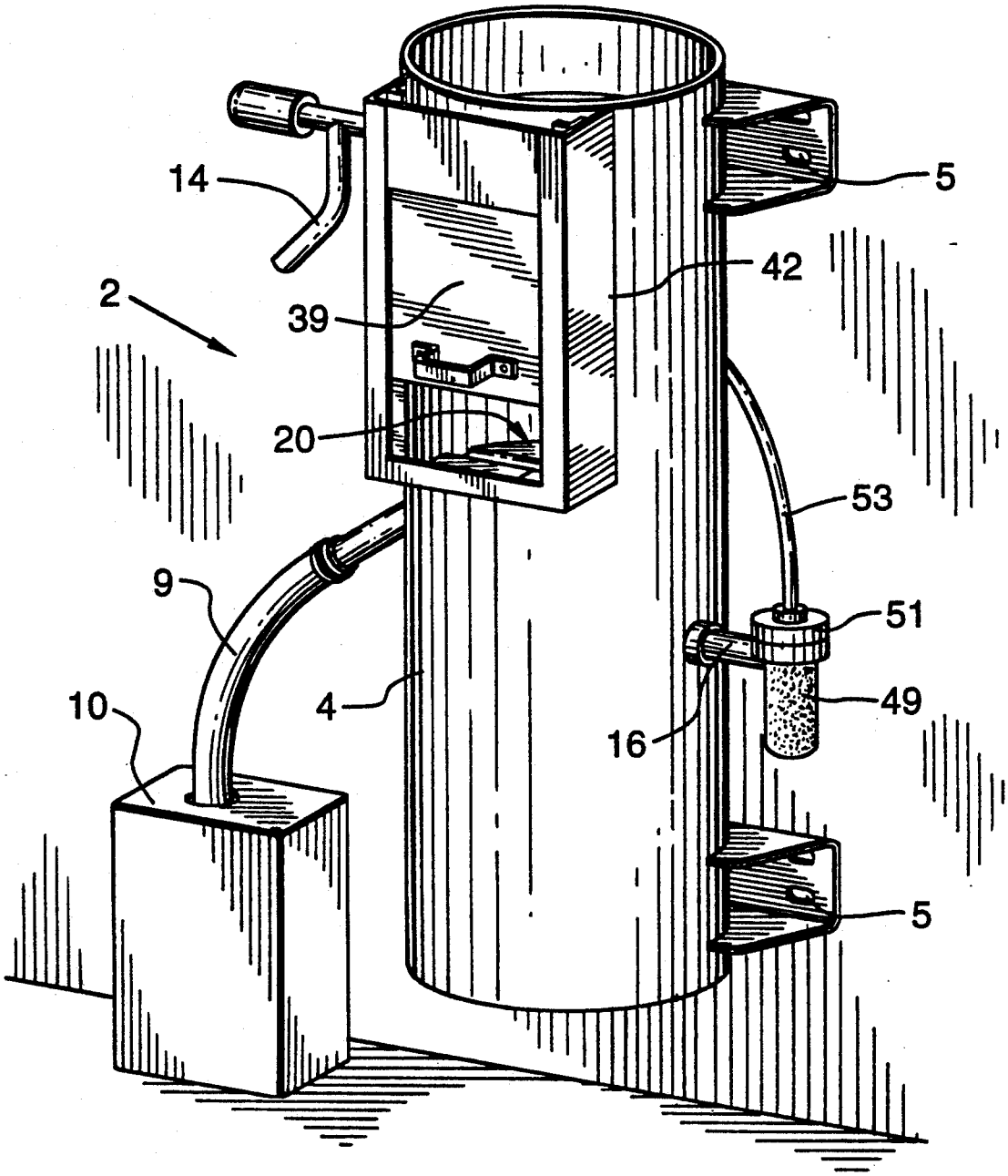
FIG. 1B is the same view as FIG. 1, but is shown with a sliding door of the apparatus in an open condition.
Figure 2:
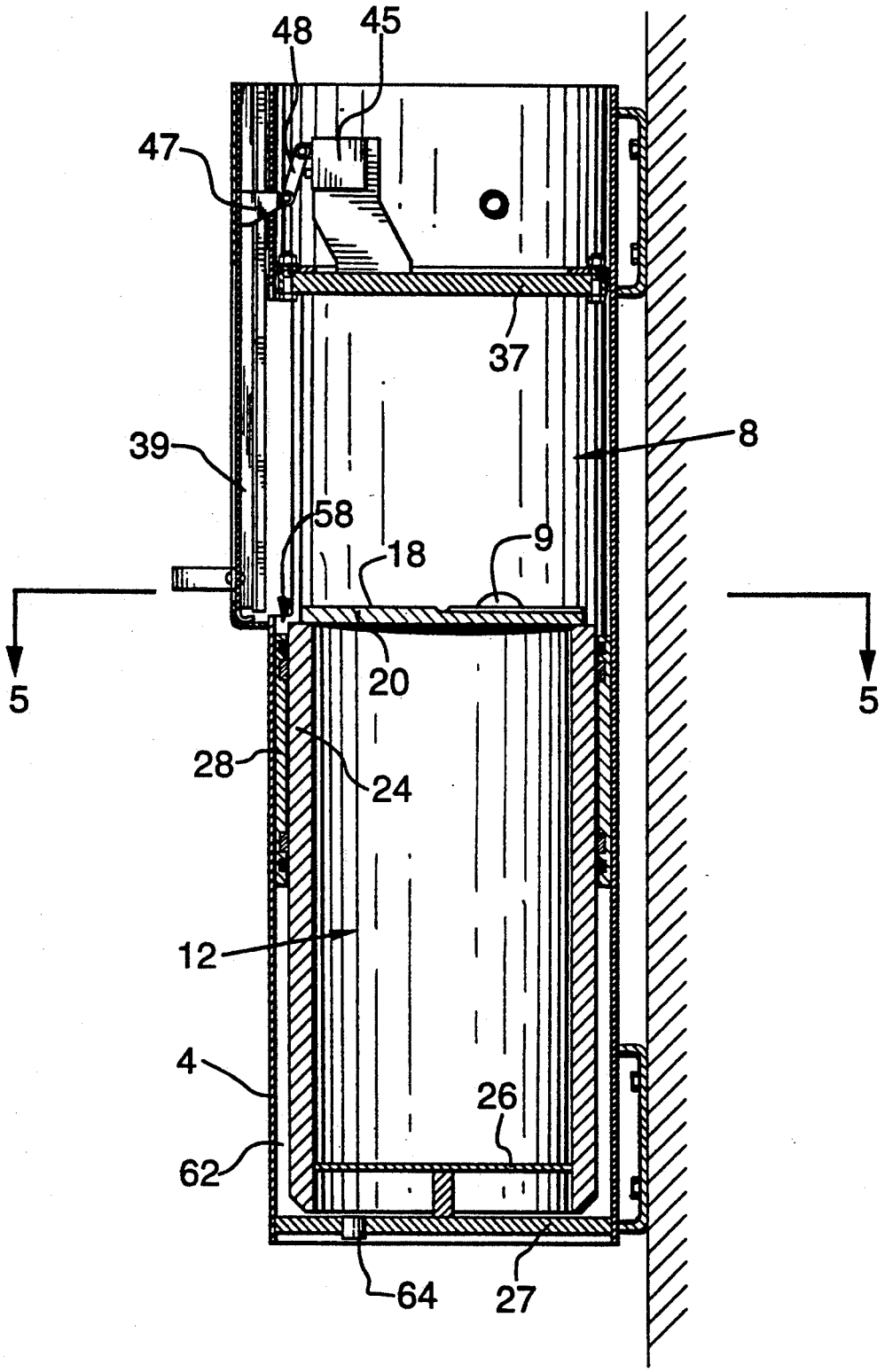
FIG. 2 is a side elevation, shown in cross-section, of the apparatus of FIG. 1.
Figure 3:
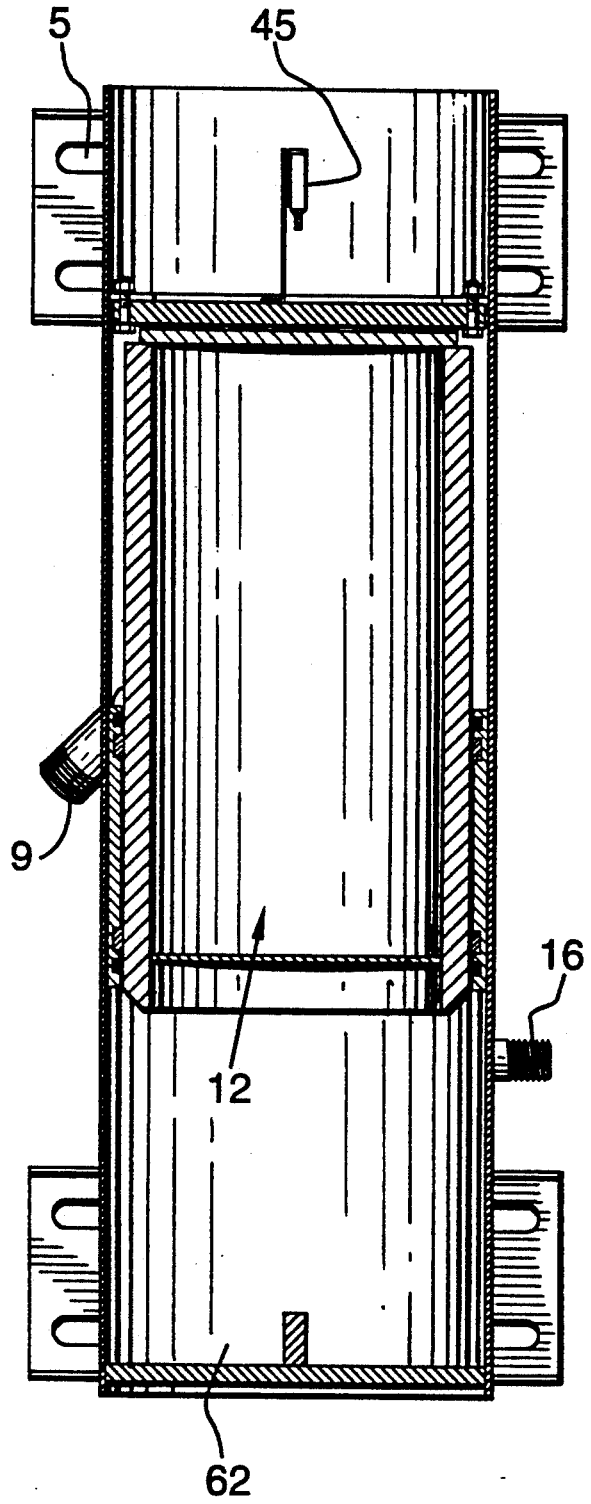
FIG. 3 is a front elevation, shown in cross-section, of the apparatus of FIG. 1.
Figure 4:
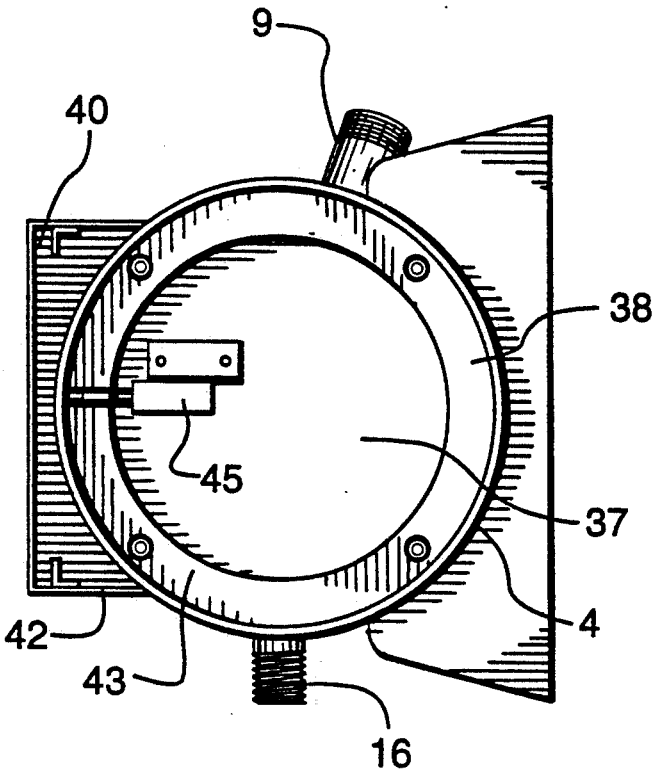
FIG. 4 is a plan view of the apparatus of FIG. 1.
Figure 5:
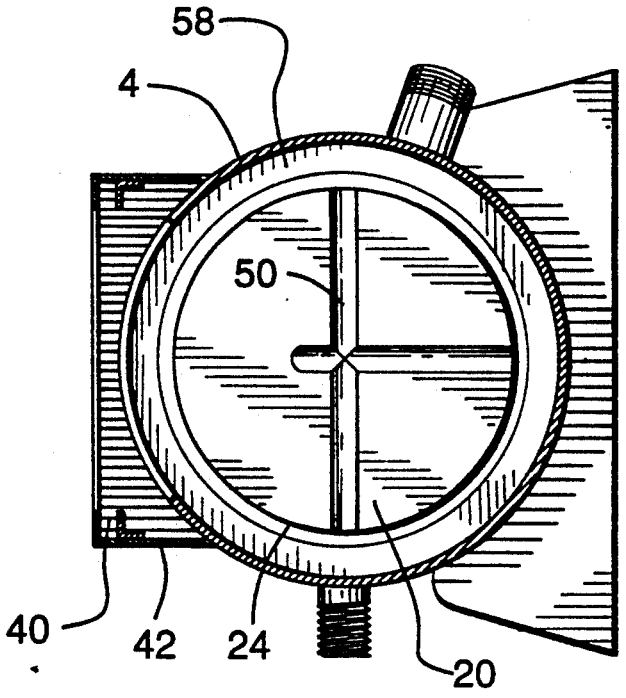
FIG. 5 is a plan view of the apparatus of FIG. 1, shown in cross-section on line 5—5 of FIG. 2.
Figure 6:
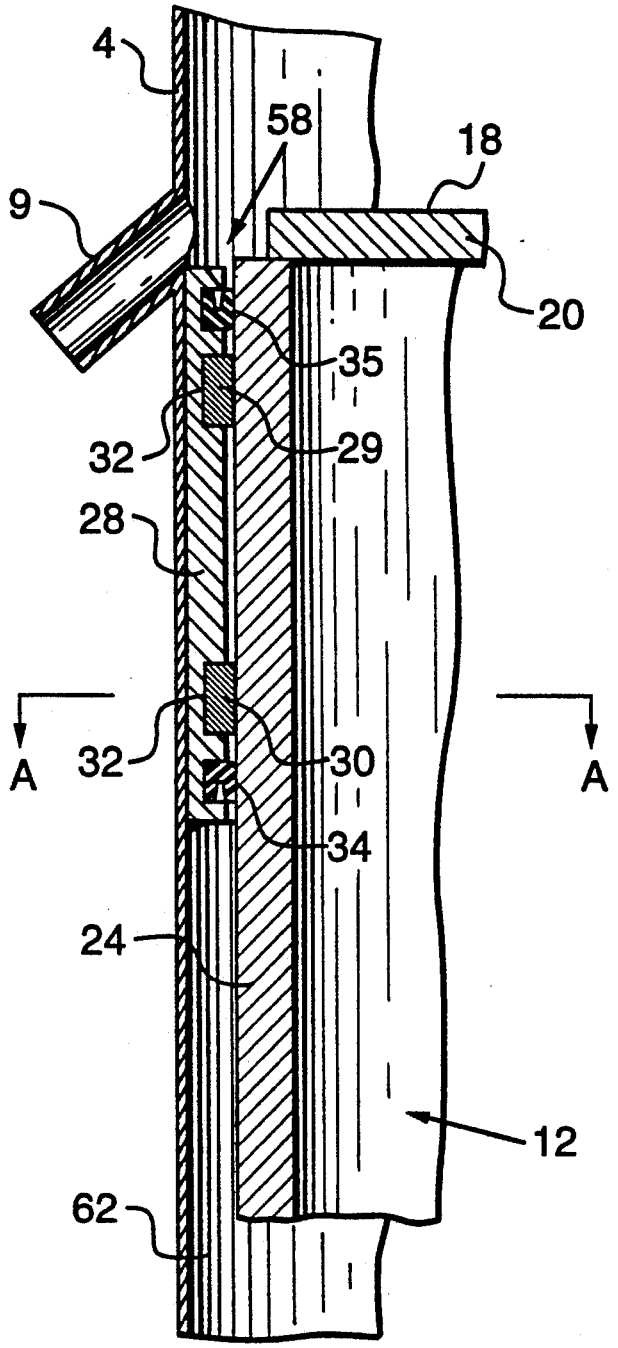
FIG. 6 is a close-up view of a portion of the apparatus.

A window 6 is cut out of the body tube 4, through which access may be had to a crusher chamber 8 defined by the hollow interior of the body tube. A door assembly is provided for closing off the window 6, but the components of the door assembly are omitted from FIG. 1A.

Used oil filters are placed in the chamber 8 for crushing. Oil squeezed out of the filters passes down an oil discharge pipe 9 and into a suitable receptacle 10.

The crushing of the oil filters is accomplished by the forceful upward movement of a piston 12, under the action of pneumatic pressure. Compressed air is fed to the crusher through a supply line 14, and passes into the body tube through a port 16.

The floor of the chamber 8 is constituted by the top surface 18 of a piston platen 20. The platen 20 is an integral component part of the piston 12, which includes also a skirt 24, having an outer cylindrical surface 25, the skirt being welded to the platen 20. The piston 12 is closed at the bottom by means of a welded-in plate 26.

The body-tube 4 is closed at the bottom by means of a welded-in bottom tube plate 27.

The piston 12 runs in a cylinder 28, which is welded into the body tube 4. The bottom of the body tube is closed off, creating a pressurisable cylinder chamber. The piston is guided for up/down sliding motion within the cylinder 28 by means of upper and lower bearings strips 29,30. The piston is sealed into the cylinder against the pneumatic pressure by means of a lip-type seal 34. A similar seal 35 is provided at the top of the cylinder 28 to keep the cylindrical surface 25 of the skirt-24 wiped clean.

In a typical case, the diameter of the skirt of the piston 12 is 22 or 23 cm. Thus the cross-sectional area of the piston is approximately 400 sq cm. When pressurised using ordinary pneumatic supply equipment, of the kind likely to be found in any motor service shop, and operating at 550–1000 kN/sq-m (80–150 psi), such air pressure is sufficient to provide a crushing force of 3 or 4 tonnes, which is ideally suited for crushing used oil filters, and for squeezing the oil out of the filter.

The bearings strips 29,30 comprise bands of anti-friction material, wrapped around the circumference of the skirt 24. The bands do not constitute complete circles.

The bearing strips 29,30 are spaced some 14 cm apart, and lie in bearing grooves 32 formed in the cylinder wall.

Though of light construction, such bearings provide enormously massive support for the piston. The piston itself is of extremely robust construction (typically the piston weighs 30 kg).

As a result, the motion of the piston takes place in a very tightly constrained vertical up/down mode. Even if a careless operator were to place the used oil filter over to one side of the platen 20, the resultant side-load on the piston is amply catered for by the massive bearing location as described.

This massive guidance of the piston 12 in the apparatus as described may be contrasted with that of a piston in a hydraulic system. When a crushing force in the region of three tons is required, a design engineer usually turns to hydraulic actuation. However, in the hydraulic case the working pressures are ten or twenty times greater, and the areas of the components are proportionately smaller. If hydraulics were to be used, and if the hydraulic piston were to be guided in bearings of the same diameter as the hydraulic seals (perhaps as little as 5 cm in diameter) the platen would be located in so flimsy a manner that the platen would easily rock and tip.

It may be surmised that, if the engineer were to select hydraulic actuation, the seal surface could not be used as the bearing surface, and a larger diameter, more massive, bearing arrangement would have to be provided in the apparatus, in addition to the sealing surface, in order to properly guide the piston.

No difficulties arise in this area, however, in the apparatus as described. The piston runs in bearings that utilise the same surface as the seals. Therefore, even though the piston is guided with great rigidity and constraint, the bearings cost practically nothing, given that the seals and seal mountings and seal surface have to be provided in any event.

It may be noted that the piston 12 is not actually physically connected to any other component. The piston simply slides up and down inside its guiding cylinder 28 under the direct action of air pressure. Thus, apart from the piston itself, in the apparatus described there are no other moving components to be sealed and guided for constrained movement.

This massive constraint against rocking and tipping of the piston 12 is present even when the piston is at the top of its stroke.

In summary: the piston bearings are so massively rigid because the bearings are of such large diameter. Normally, providing large diameter bearings is inordinately expensive, but the piston is already of a large diameter, in order to generate the required force of 3 or 4 tonnes from a shop air compressor, and therefore the massive bearings are achieved for very little cost.

As mentioned, the piston has a diameter of some 22 cm. As may be seen from the drawings, the crusher chamber 8 has a diameter a little greater than that; the chamber 8 therefore is amply large enough to receive an oil filter. Not only that, but also the chamber 8 is amply large enough for the operator's hands, whereby the operator has no difficulty whatever in reaching inside the chamber to place a filter therein or to take a crushed filter out.

The chamber should be large: the walls of the chamber inevitably become doused with the oil squeezed from the filter, and it is important for user-acceptability that, when the mechanic reaches into the chamber, the chamber is large enough that he can pass his hands into the chamber easily without touching surfaces that are dripping with dirty oil.

Again, the large diameter of the chamber 8 arises at no extra cost, as a consequence of the large diameter of the piston 12.

The crusher chamber 8 has a roof in the form of a roof platen 37. The roof platen 37 is bolted to a flange 38, which is welded inside the main body tube 4. Each bolt hole in the flange 38 in fact is only half a hole, the other half of the hole being provided in a reinforcing ring 43 welded to the platen 37. The reason for this arrangement is that the flange 38 must be narrow (in the radial sense); in fact the inner diameter of the flange must be large enough to allow the piston to pass through, for assembly and disassembly purposes. The half-hole arrangement does not matter from the strength standpoint; the heavy forces acting upon the roof platen when the oil filter is being crushed are transmitted from the platen to the flange by direct contact: the bolts serve only to keep the platen in position, not to support any heavy forces.

The chamber 8 is closed off by means of a door 39. The door 39 is guided in runners 40 for up-and-down sliding. The runners 40 are formed as part of a door frame 42, which is welded onto the side of the main body tube 4. The door and door frame are arranged to totally enclose the window 6 cut out of the main body tube 4. The door 39 is arranged to fall to the closed position under gravity, so that the mechanic must hold the door open with one hand whilst he inserts the used oil filter in the chamber 8.

Figure 8:
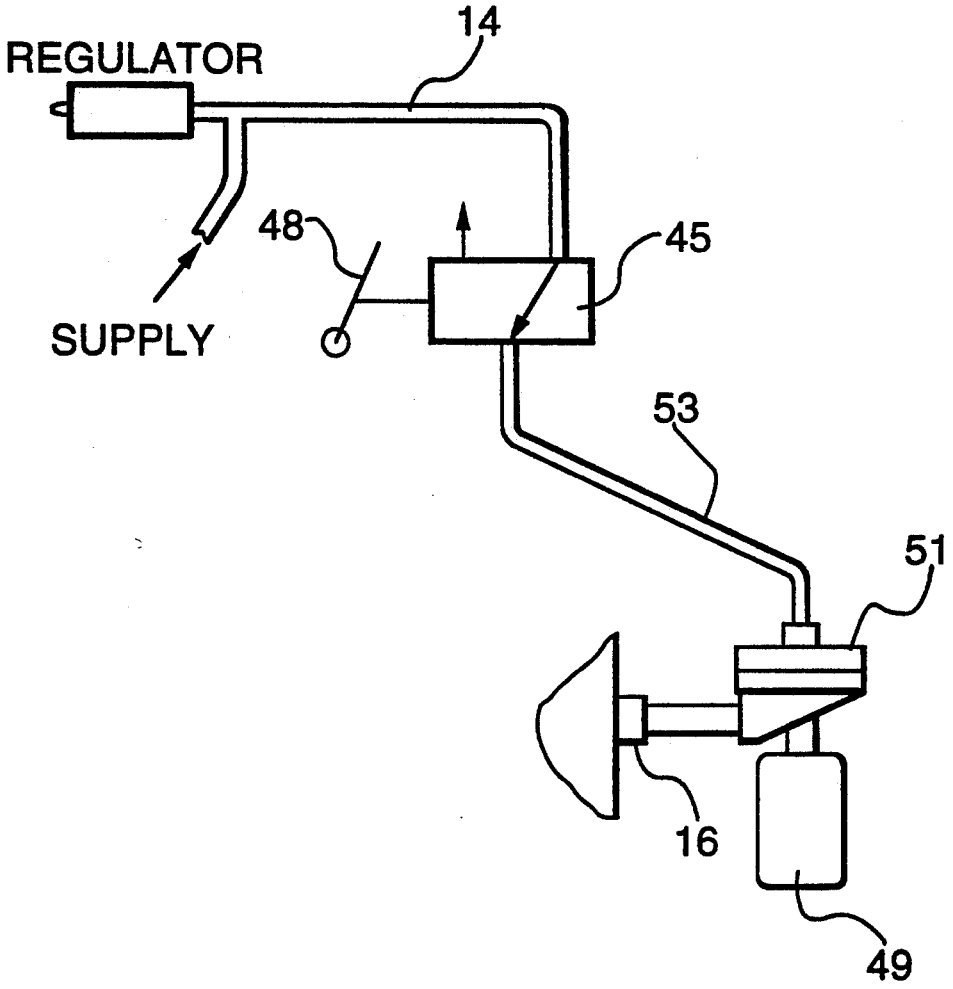
FIG. 8 is a diagram showing the arrangement of pneumatic components associated with the apparatus of FIG. 1.
Figure 9:
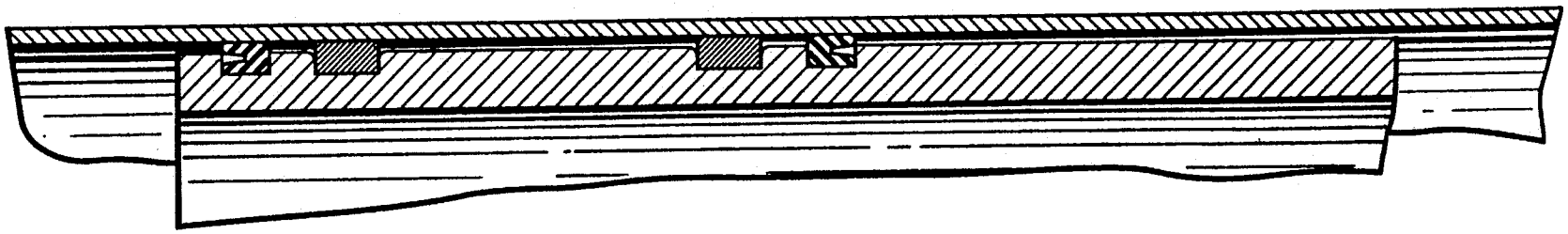
FIG. 9 is a cross-section corresponding to FIG. 6, of a portion of the piston and cylinder arrangement in another embodiment.
Figure 10:
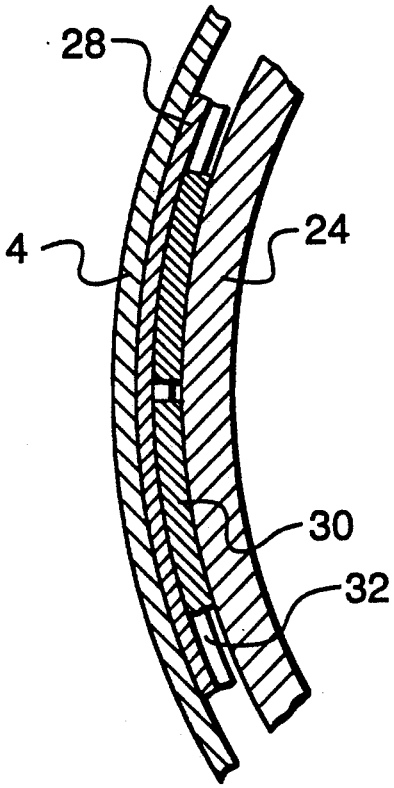
FIG. 10 is a cross-sectional plan view on line 10—10 of FIG. 6.

The apparatus includes a pneumatic trip switch 45, which senses the position of the door 39. When the door is closed, a tab 47 on the door engages the actuation arm 48 of the trip switch 45, and the pneumatic circuit (see FIG. 8) is so arranged that when the trip switch is in the activated condition, air pressure is supplied to the piston via the port 16. When the door is opened, by about 5 mm, the tab 47 disengages the arm 48; the air pressure contained in the piston then exhausts through the muffler 49.

The muffler 49 is attached to a conventional quick-exhaust valve 51, which operates as follows. When air pressure is present in the line 53, the pressure sets the quick-exhaust valve 51 to direct the air pressure from line 53 into the port 16, and thence to the piston 12, and to close off the muffler 49. When pressure in the line 53 drops (which happens when the trip-switch 45 is deactivated) the quick-exhaust valve 51 now sets itself to allow the compressed air supporting the piston to exhaust not only through the line 53 but also through the muffler 49. The quantity of compressed air under the piston is considerable, and it would take several seconds for the compressed air to exhaust if its only escape were through the line 53: the quick-exhaust valve 51 is provided in order to allow the compressed air to be exhausted much more quickly through the muffler 49.

The piston therefore remains in the up position, under pressure, squeezing the contents of the chamber hard against the roof of the chamber, when the door is closed. The act of closing the door causes the piston to rise. Similarly, when the door is open the piston is exhausted of air, and is down; and the act of opening the door causes the piston to fail. The piston cannot rise while the door is open, and cannot fall while the door is closed.

The top surface 18 of the platen 20 is provided with grooves 50. The grooves serve to receive and convey the dirty oil from the filter. An oil filter invariably has a rubber sealing ring 52, and during crushing this ring seats on the surface 18: without the grooves 50, the ring 52 would seal against the surface 18, with the result that the oil could not escape as the filter was being crushed, so that the canister 53 of the filter would then burst. Therefore the grooves 50 must be present to ensure that oil can escape from the filter.

The grooves 50 extend radially, to allow the oil to flow outwards. The number of grooves is not important; three are present in the apparatus described. It is important, however, that the grooves be directed away from the door, so that jets of oil squirting from the grooves are directed away from the door. The back of the door will of course receive some oil splashes.

Even though the mechanic is working with dirty, oily, components, nevertheless it would be a problem if the door were to drip dirty oil over the hands and cuffs of the mechanic, every time he raised the door. It has been found that with the grooves 50 pointing away from the door, as described, the amount of oil dripping from the door, upon opening, is negligible; when the grooves point towards the door, the difference is immediately apparent.

The piston 12 is not located against rotation, and sometimes the piston, after repeated operation, can work itself around so that one of grooves starts to point at the door: the mechanic should then twist the piston to re-align the grooves away from the door.

Also, the bottom of the door is bent upwards to form a deflector 56, which resists the formation of drips.

The door 39 is arranged to slide vertically upwards upon opening, as described. Any drips that do occur therefore fall into the door frame, so that the sill of the door frame serves as a drip tray.

It may be noted that the vertically sliding door arrangement is much preferred over a hinged door arrangement, for which it would be difficult to provide a convenient drip tray. With a hinged door, it would be difficult to prevent drips of dirty oil falling to the floor.

When the dirty oil is squeezed from the used oil filter, it passes, via the grooves 50, into the crusher chamber 8. The dirty oil eventually flows out through the discharge pipe 10; but dirty oil is viscous and slow flowing, and it is important to keep the top surface of the platen 20 free from an actual depth of oil accumulating thereupon, as that would become quite messy.

The outer diameter of the piston platen 20, therefore, is deliberately made considerably smaller in diameter than the inside of the main body tube 4, whereby a trough 58 is defined around the platen 20. This trough has sufficient volume to accommodate the dirty oil squeezed from one, or even from two, filters. The mechanic can therefore proceed to crush many filters one after another, and the oil squeezed from a senior filter will collect in the trough and then enter the dischage pipe 10, without accumulating a depth of oil on the platen, while a junior filter is being processed.

The sill of the window 6 in the main tube 4 is high enough also to contain any oil accumulated in the trough 58, whereby the oil does not escape under the door 39.

Figure 7:
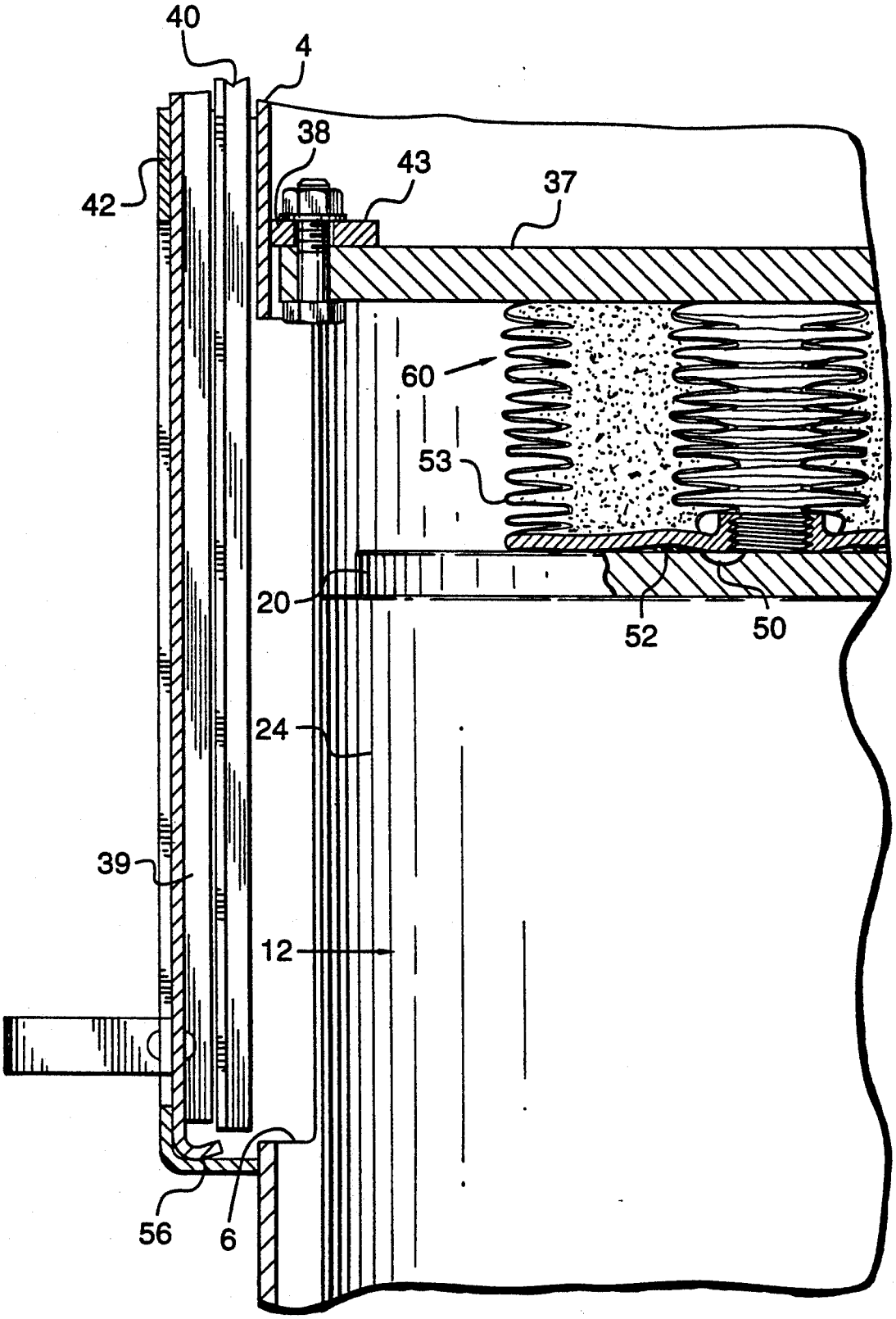
FIG. 7 is a close-up view of a portion of the apparatus, and shows also a used oil filter being crushed in the apparatus.

As shown in FIG. 7, the oil filter 60 is squashed flat. Typically, the filter is squashed to about a quarter of its nominal height. As shown, the crushed filter, though very severely crushed, remains straight. The apparatus as described in fact is very effective at keeping the filter straight during crushing, and this is important. If the filter were to tip or lean over, a component of the crushing force would be applied to the cylindrical portion of the canister, and the resulting mode of collapse of the filter would be unpredictable. In fact, in the case of a crushing apparatus that permits filters to tip sideways, even slightly, the metal of the canisters of the filters can be expected to be torn. The resulting (very) sharp edges pose a hazard for the mechanic. Filters crushed in the apparatus as described can be expected to be flattened in a straight line, and can be expected to be free from tears and sharp edges.

It takes a few seconds for all the oil to be squeezed out of the filter. The fact that the piston is pneumatically actuated (as opposed to hydraulic actuation) means that the piston can move at its own speed: The sequence of movements is as follows: first the canister 53 resists distortion, and the force builds up from the piston, while the piston travels slowly; then the canister suddenly collapses, and the piston rises quickly; thirdly, when the canister is fully crushed, squeezing commences, and the piston again moves slowly. With pneumatic actuation, the piston tends to move quickly when resistance is low, and slowly when a resistance builds up, whereas with hydraulic actuation, the piston tends to move more at a constant speed, irrespective of the varying resistance. The speed of travel of the piston in a hydraulic operation has to be "geared" to the maximum resistance. Over much of the stroke of the piston the force is quite low, once the canister has collapsed. Therefore a hydraulic actuation system would spend much time with the piston moving relatively slowly, but the pneumatic actuation can take advantage of a light resistance to quickly take up the slack. Therefore, all else being equal, pneumatic actuation has a smaller "dead" time, and can be expected to lead to a shorter per-filter time, and to a better throughput of filters crushed in a unit time.

With pneumatic actuation the piston will move quickly when the force is low. In the apparatus described, the heavy piston 12 has a good deal of momentum, and it can sometimes accelerate and decelerate quite violently. The bolts 5, and the wall to which the apparatus is attached, should therefore be of a sturdy character.

As mentioned, to operate the apparatus, the mechanic simply raises the door 39, places the filter in the chamber 8, and then lowers the door. He does not have to press any buttons, nor does he have to remain by, or give any attention to, the crusher while crushing is taking place. This is an advantage because it can take some seconds for a filter to be completely crushed: that is to say, if the filter were taken out prematurely it would contain more residual oil than if left for a few more seconds. The aim is to squeeze 95% of the oil out of the filter, and that percentage is maximized if the squeeze is left on, after the filter has been crushed, for a few more seconds.

The apparatus as described is operated entirely pneumatically. No electrical supply or components are required. As mentioned, the only action required of the mechanic in order to crush a filter is to lift the door, place the filter inside, and then lower the door. He may then walk away. In addition to there being no electrical switches or buttons to operate, the absence of electricity means that no precautions need be taken to contain sparks, which might present a fire or explosion hazard, in the presence of compressed oily air. In fact, the airspace 62 below the piston, into which the pressurised air is admitted, will gradually accumulate oil, water, and dirt. A drain 64 is provided for removing same. After a crushing cycle, the spent air is discharged through the muffler 49, and the condition of this muffler will serve to indicate whether oil, water, dirt, etc are starting to build up in the space.

The cylindrical surface 25 of the piston 12 is doused with oil each time a filter is crushed, which serves to keep the piston well-lubricated. Most of the oil is wiped off by the wiper 35, but some oil does get by, and enters the space 62. Also, when the canister collapses, the paint on the canister usually flakes off, and the flakes can work down, past the wiper, and into the airspace 62. As mentioned, with the described apparatus there is virtually no tendency for the canister to tear, and so there is very little tendency for metal pieces, from the canister, to be present in the chamber 8. Of course the oil itself often contains metal shavings, trapped in the filter, but these tend to be flushed down the discharge pipe 10, and do not tend to pass the wiper and enter the airspace 62.

As mentioned, the squeezed-out oil serves to keep the piston well-lubricated. It has been found that if non-oil-containing articles are crushed in the apparatus, the piston can become dry. The piston can then start to stick in the "up" position, even though the piston is very heavy. Therefore, the feature of the apparatus that the piston falls under its own weight, as in the apparatus described, is particularly applicable to an apparatus for crushing oil filters. Because of the excessive lubrication, the designer can trust the piston not to stick, even over a long service life.

It is usual in any pneumatic system for the designer to specify that the compressed air should pass through a lubricator. The droplets of lubricant in the compressed air, as provided by the conventional lubricator, serve to ease the operation of rams, valves, and other components. In the case of the apparatus as described, however, it would be almost impossible economically to provide adequate lubrication for the the huge piston, if the means for doing so were the conventional pneumatic lubricator. Therefore, the fact that the piston is doused in copious quantities of oil each time a filter is crushed in fact is an important factor in the operation of, and economy of, the apparatus.

Were it not for the fact that the piston is repeatedly doused in oil, the piston could not be relied upon to fall under its own weight. It follows that, in that case, some form of piston-return mechanism would be needed. This shuld be contrasted to the tremendous simplicity of the means of operation of the piston as described.

The manner of actuation of the apparatus is such that even the most casual mechanic cannot fail to operate the machine correctly, and also safely. The mechanic cannot place his hand inside the chamber until the door is open, and the piston cannot rise while the door is open, i.e. while the mechanic's hand is inside. Such simple foolproof actuation is very safe, even against the kind of person who will deliberately seek to over-ride a safety interlock, if such were provided.

When the mechanic closes the door, the piston rises, so that when the machine is not in operation, the piston is pressed upwards, and remains pressurised. It might be considered that leaving the piston in the pressurised "up" condition poses a hazard. It is contemplated therefore that the actuation system might alternatively be so arranged as to respond to a "door-half-closed" position.

If the trip valve 45 is set to lower the door when the door has been raised say 5 mm, this half-closed condition would be where the door is open perhaps 7 mm, whereby when the door is in this half-closed position, the piston is down. The door would be provided with a suitable detent means to support it when unattended in this position.

In the half-closed position, the door is open far enough to actuate the valve 45, and therefore to lower the piston 12. Thus, when the door is half-closed, the piston resides in the down position; when the mechanic raises the door, from this half-closed condition, the piston is already down. When he wishes to crush a filter, the mechanic closes the door upon the filter, and closes the door completely, i.e. to the fully-closed position. This actuates the valve and makes the piston rise. When he has finished the filter (or batch of filters), if he then takes care to close the door only to the half-closed-position, and leave it there, the piston will remain down, and unpressurised.

Preferably, as shown, the piston seal 34 is housed in a groove in the cylinder 28; however, in general, the piston seal is housed in a piston seal groove located in one of either the piston or the cylinder chamber, and the piston seal slidably engages a sealing surface located in the other of either the piston or the cylinder chamber.

Similarly, preferably the piston bearing strips 29, 30 are also mounted in the cylinder 28; however, in general, the piston bearing comprises an anti-friction means, which is mounted in a bearing housing located in one of either the piston or the cylinder chamber, and the anti-friction means movably engages a bearing surface located in the other of either the piston or the cylinder chamber.

We claim:

1. Apparatus which is suitable for crushing a liquid containing object, wherein:

the apparatus includes a main body; the body includes a crusher chamber, and includes an opening into the crusher chamber through which the object to be crushed can be placed in the chamber;

the apparatus includes a door for closing the opening; the door is movable between a fully closed condition and an open condition, with respect to the opening;

the open condition is a condition of the door in which the door lies between being fully open and being so nearly closed that substantially all access is denied thereby to the crusher chamber, but does not include the fully closed condition;

the body is so adapted and arranged that, when the door is in the fully closed condition, the crusher chamber is effective, in operation of the apparatus, to contain liquid jetting and splashing from the object within the crusher chamber, and to substantially prevent such liquid from passing out of the crusher chamber;

the apparatus includes a discharge pipe means, which communicates with the crusher chamber, and which is suitable for receiving and conveying away liquids emanating from within the crusher chamber;

the apparatus includes a piston residing in a piston bearing which is effective to guide and constrain the piston for linear movement within and relative to the main body;

the apparatus includes a pair of platens, located in the crusher chamber, which are suitable for receiving the object to be crushed directly therebetween;

one of the platens, termed the piston platen, is operatively integral with the piston;

the apparatus includes a cylinder chamber, the piston being located inside the cylinder chamber;

the apparatus includes a piston seal, which is so located and arranged as to act between the piston and the cylinder chamber, and as to slidably seal the piston to the cylinder chamber;

the piston forms a movable wall of the cylinder chamber;

the cylinder chamber is enclosed and sealed, except for a port, which is effective to admit air under pressure into the cylinder chamber;

the apparatus includes an operable air supply means, which is effective, when operated, to supply compressed air to the port of the cylinder chamber;

the piston seal is housed in a piston seal groove located in one of the piston and the cylinder chamber, and the piston seal slidably engages a sealing surface located in the other of the piston and the cylinder chamber, respectively;

the piston bearing comprises an anti-friction means, which is mounted in a bearing housing located in one of the piston and the cylinder chamber, and the anti-friction means movably engages a bearing surface located in the other of the piston and the cylinder chamber, respectively;

the piston is movable between a retracted position, in which the platens are separated, and a crushing position, in which the platens are together;

the sealing surface has a cross-sectional area of more than 300 sq cm;

and the bearing surface has a cross-sectional area of more than 300 sq cm;

the apparatus includes a door-biassing means, which is effective to bias the door, when in the open condition, towards the fully closed condition;

the apparatus includes a piston-biassing means, which is effective to bias the piston towards the retracted position;

the air supply means includes an operable trip valve, which is arranged to be operated by movement of the door, the manner of the arrangement being such that when the door is in the fully closed condition pneumatic pressure is supplied to the port of the cylinder chamber, and being such that when the door is in the open condition pneumatic pressure is exhausted from the cylinder chamber.

2. Apparatus of claim 1, wherein the sealing surface has a cross-sectional area of about 400 sq cm; and the bearing surface has a cross-sectional area of about 400 sq cm.

3. Apparatus of claim 1, wherein:

the piston includes a skirt, and the skirt has an outer cylindrical surface;

the piston seal groove, and the bearing housing are immovable with respect to the main body;

and the outer cylindrical surface of the piston skirt comprises both the sealing surface and the bearing surface.

4. Apparatus of claim 1, wherein:

the piston-biassing means comprises a means for guiding the piston for descent, under gravity, to the retracted position of the piston;

the piston bearing guides and constrains the piston for vertical up/down movement relative to the cylinder chamber;

and the piston is heavy enough to fall under its own weight, when the cylinder chamber is not pressurised, against the resistances of the piston seal and the piston bearing.

5. Apparatus of claim 4, wherein the piston weights about 30 kg.

6. Apparatus of claim 4, wherein: the piston includes a skirt having an upper portion and the apparatus is so arranged that, when the cylinder chamber is pressurised, the piston rises, and the upper portion of the skirt of the piston emerges into the crusher chamber;

the apparatus is so arranged that a liquid containing object placed in the cylinder chamber is crushed by the rising piston, whereupon liquid and splashes from the object;

and the upper portion of the piston skirt is exposed to liquid jetting and splashing from the object;

7. Apparatus of claim 4, wherein the piston platen has a top surface which is formed with liquid run-off grooves, the grooves being disposed radially upon the platen.

8. Apparatus of claim 4, wherein:

the anti-friction means includes an elongate bearing strip of anti-friction material, wrapped around the circumference of the bearing surface, the strip being not circumferentially continuous;

and the bearing housing comprises a bearing groove formed in a wall of the cylinder chamber, the strip being located in the bearing groove.

9. Apparatus of claim 8, wherein the piston includes a skirt having an outer cylindrical surface and the apparatus includes two of the bearing strips, each housed in a respective bearing groove, and the two are well-spaced apart vertically upon the outer cylindrical surface of the piston skirt.

10. Apparatus of claim 9, wherein:

the apparatus includes a wiper seal, which slidably touches and wipes the outer cylindrical surface of the skirt of the piston;

the cylinder chamber is defined, in part, by a cylindrical wall, operatively integral with the main body, which is complementary to the outer cylindrical surface of the piston skirt;

and the wiper seal is located in a wiper seal groove formed in the wall of the cylinder chamber;

and the wiper seal groove, the two spaced bearing grooves, and the piston seal groove, are disposed in that vertical order downwards, in the wall of the cylinder chamber.

11. Apparatus of claim 4, wherein:

the main body includes a flange, which is operatively integral therewith;

the other of the platens, termed the roof platen, is secured to the flange, and forms the roof of the crusher chamber;

the roof platen is so secured to the flange as to be detachable therefrom;

the dimensions of the flange are such that, with the roof platen detached from the flange, the piston can pass through the flange, for assembly purposes.

12. Apparatus of claim 4, wherein:

the piston includes a skirt having an outer cylindrical surface and the apparatus includes a wiper seal, which slidably touches and wipes the outer cylindrical surface of the skirt of the piston;

and the wiper seal is located in a wiper seal groove formed in a wall of the cylinder chamber.

13. Apparatus of claim 1, wherein the door-biassing means comprises a means for guiding the door for descent of the door, under gravity, to the fully-closed condition of the door, comprising a door frame in which the door is guided and constrained for vertical up/down sliding movement.

14. Apparatus which is suitable for crushing a liquid containing object, wherein:

the apparatus includes a main body;

the body defines a crusher chamber, and includes an opening into the crusher chamber through which the object to be crushed can be placed in the chamber;

the apparatus includes a door for closing the opening;

the body is so adapted and arranged that, when the door is in position to close the opening, the crusher chamber is effective, in operation of the apparatus, to contain liquid jetting and splashing from the object within the crusher chamber, and to substantially prevent such liquid from passing out of the crusher chamber;

the apparatus includes a discharge pipe means, which is suitable for receiving and conveying away liquids emanating from within the crusher chamber;

the apparatus includes a piston, and a piston bearing which is effective to guide and constrain the piston for linear movement within and relative to the main body;

the apparatus includes a pair of platens, located in the crusher chamber, which are suitable for receiving the object to be crushed directly therebetween;

one of the platens, termed the piston platen, is operatively integral with the piston;

the apparatus includes a cylinder chamber;

the apparatus includes a piston seal, which acts between the piston and the cylinder chamber, and which slidably seals the piston to the cylinder chamber;

the piston forms a movable wall of the cylinder chamber;

the cylinder chamber is enclosed and sealed, except for a port, which is effective to admit air under pressure into the cylinder chamber;

the apparatus includes an operable air supply means, which is effective, when operated, to supply compressed air to the port of the cylinder chamber;

the piston seal is housed in a piston seal groove located in one of the piston and the cylinder chamber, and the piston seal slidably engages a sealing surface located in the other of the piston and the cylinder chamber, respectively;

the piston bearing comprises an anti-friction means, which is mounted in a bearing housing located in one of the piston and the cylinder chamber, and the anti-friction means movably engages a bearing surface located in the other of the piston and the cylinder chamber, respectively;

the sealing surface has a cross-sectional area of more than 300 sq cm;

and the bearing surface has a cross-sectional area of more than 300 sq cm;

the piston includes a skirt, and the skirt has an outer cylindrical surface;

the piston bearing guides and constrains the piston for vertical up/down movement relative to the cylinder chamber;

and the piston platen has a top surface which is formed with liquid run-off grooves, the grooves being disposed radially upon the platen.

15. Apparatus of claim 14, wherein:

the piston includes a skirt having an upper potion and;

the apparatus is so arranged that, when the cylinder chamber is pressurised, the piston rises, and the upper portion of the piston skirt emerges into the crusher chamber;

the apparatus is so arranged that a liquid containing object placed in the cylinder chamber is crushed by the rising piston, whereupon liquid jets and splashes from the object;

the upper portion of the skirt is exposed to liquid jetting and splashing from the object;

and the grooves are so orientated in the top surface of the piston platen that none of the grooves direct liquid jetting from the object towards the door.

* * * * *